US006773012B1

(12) United States Patent
French

(10) Patent No.: US 6,773,012 B1
(45) Date of Patent: Aug. 10, 2004

(54) CARD GAME

(75) Inventor: R. Michael French, Louisville, KY (US)

(73) Assignee: LaGrange Woods, Inc., Louisville, KY (US)

( * ) Notice: Subject to any disclaimer, the term of this patent is extended or adjusted under 35 U.S.C. 154(b) by 0 days.

(21) Appl. No.: 10/616,600

(22) Filed: Jul. 10, 2003

(51) Int. Cl.[7] ..... A63F 1/00
(52) U.S. Cl. ..... 273/292; 273/274; 273/309
(58) Field of Search ..... 273/292, 274, 273/309; 463/12, 13

(56) References Cited

U.S. PATENT DOCUMENTS 5,141,234 A * 8/1992 Boylan et al. ..... 463/12
5,314,193 A * 5/1994 Ferrer ..... 273/292
5,476,265 A * 12/1995 Miller et al. ..... 273/292
5,632,486 A * 5/1997 Mkrtchyan ..... 273/292
5,632,487 A * 5/1997 Nguyen ..... 273/292
5,632,489 A * 5/1997 Rozzi et al. ..... 273/304
6,345,823 B1 2/2002 Webb
6,503,145 B1 1/2003 Webb
6,511,072 B1 1/2003 Santa Cruz et al.
6,536,768 B2 3/2003 Caputo
6,536,769 B1 3/2003 Palacios et al.
6,543,773 B2 4/2003 Mims

* cited by examiner

*Primary Examiner*—Benjamin Layno
(74) *Attorney, Agent, or Firm*—Stites & Harbison PLLC; John E. Vanderburgh

(57) ABSTRACT

A method for playing a card game in which two columns of cards of given point value are dealt to each player and in which the player with the lowest point difference between the two columns of cards is the winner. The game is ideally suited to be played at home and for casino play with a casino dealer, particularly since there is no need for the players to handle the cards. In addition, other games such as Three-Card Poker and Double Three-Card Poker can be played as integral elements of the basic game.

31 Claims, 3 Drawing Sheets

CARD GAME

FIELD OF THE INVENTION

This invention relates to card games and games of chance and more particularly for a method for playing a card game in which two columns of cards of given point value are dealt to each player and in which the player with the lowest point difference between the two columns of cards is the winner.

BACKGROUND OF THE INVENTION

The popularity of card games is well established throughout the world and the majority of card games are played with a 52 or 53 card deck (counting the joker) in which cards are assigned a point value and a suit. The standard deck comprises 52 cards ranging from face cards, that is ace, queen, king and jack, down to a card with the value of two. The cards are assigned to four suits: spades, hearts, diamonds and clubs. Such a deck of cards is referred to as a standard 52-card deck although the designation of suits and even the number of cards can vary from country to country and region to region. A few of the better-known card games include Bridge, Whist, Gin, Poker and variations thereof, Blackjack and Euchre. Many of these games, most notably Poker and Blackjack, have been adapted for casino wagering. In this connection casinos are most interested in new wagering games in which players play against the "house" as represented by an employee/dealer.

Preferably wagering should be exciting and relatively easy to learn while at the same time allowing the player to exercise some strategy in attempting to have the winning hand or beat the dealer. Card games such as Blackjack and Poker have these elements which accounts for the popularity of the wagering games played in casinos as well as "friendly" games outside of casinos.

SUMMARY OF THE INVENTION

The present invention provides a card game which is easily teamed, provides players with strategy opportunities, can be rapidly played and provides excitement for the players. The game is ideally suited to be played at home and for casino play, particularly since there is no need for the players to handle the cards. In addition, other games such as Three-Card Poker and Double Three-Card Poker can be played as integral elements of the basic game. The game of the invention provides opportunities for black or red side bets and for black and red parlay betting which adds additional excitement to the game.

More particularly in one embodiment the present invention comprises a method of playing a card game among a number of players. In the casino embodiment the players play against a dealer. The method includes the steps of determining the values of a standard 52 deck of playing cards having the following values: ace equals one or eleven; king equals one-half point; queen equals one-half point; jack equals one-half point; and all remaining cards have a point value equal to their face value. Each player is provided a first and a second column, referred to the black column and the red column and the cards are dealt to the black column and the red column of each of the players.

In the home play version, each Player bets an ante bet and after the first card has been dealt in each column, each player is given an opportunity to wager beginning with the Player whose numerical spread between the two column is least; the other players must meet the wager, raise in their turn, or fold. A player who decides not to bet has "folded" and is out of the game. Dealing is repeated until there are three cards in each player's two columns. Unlike the casino version, additional wagering continues during the second and third round of dealing. Based on the assigned value to the cards, a spread between each player's two columns is determined by totaling the value of the cards in each column and subtracting the lowest total from the highest total to arrive at the difference which is the spread. The winning hand is determined by comparing each player's spread, the player with the lowest spread has the winning hand. The low spread wins the pot although when there is a tie the players who have tied will divide the pot.

In another aspect of the invention in which the game is played casino style, the dealer's final two column spread must be at or below a predetermined number in order to qualify for contest play between the individual player's hand and the dealer's hand. Additional bets can be made that cards in either or both of a player's columns will be dealt in a predetermined face value sequence or suit or suit color. Pay outs for winning hands are in accordance with a schedule predetermined by the casino. In the event the dealer fails to qualify, the house matches the player's ante bet and returns all additional bets. Once the cards are dealt, the Dealer, beginning to the Dealer's left and continuing in a clockwise direction, settles accounts with each Player in turn. The game of the present invention is highly suited for progressive wagering and the highest progressive and percentage pot progressive payoffs are so governed by a progressive pool pay out schedule and such payoffs are not split between hands of equal rank.

The game is played in a similar manner for its slot machine, video game, and scratch-off, and pull-tab versions and in that case, the value of the cards or their representations are randomly assigned as if dealt or by program simulating the deal. Such representations may include icons of sporting players, vehicles or racing animals.

DESCRIPTION OF THE PREFERRED EMBODIMENT

The game will be described hereinafter in connection with the casino version of the game. It will be understood, however, the game can be played at home in essentially the same manner employing the same rules as described herein for casino play.

As used herein the term "parlay bet" means a bet placed by a player that the suit color dealt to both first and second card columns will be of the suit color assigned to each column.

The term "progressive bet" refers to a side wager paid into a progressive play pool that includes wagers from other tables in the casino and if linked, tables in other casinos involved in playing the card game of the present invention and which pool is paid out in the event of a predetermined sequence of cards dealt into a first and/or second card position column and that, is paid out in accordance with a different schedule than the pay out schedule for the basic game.

Figure 1:
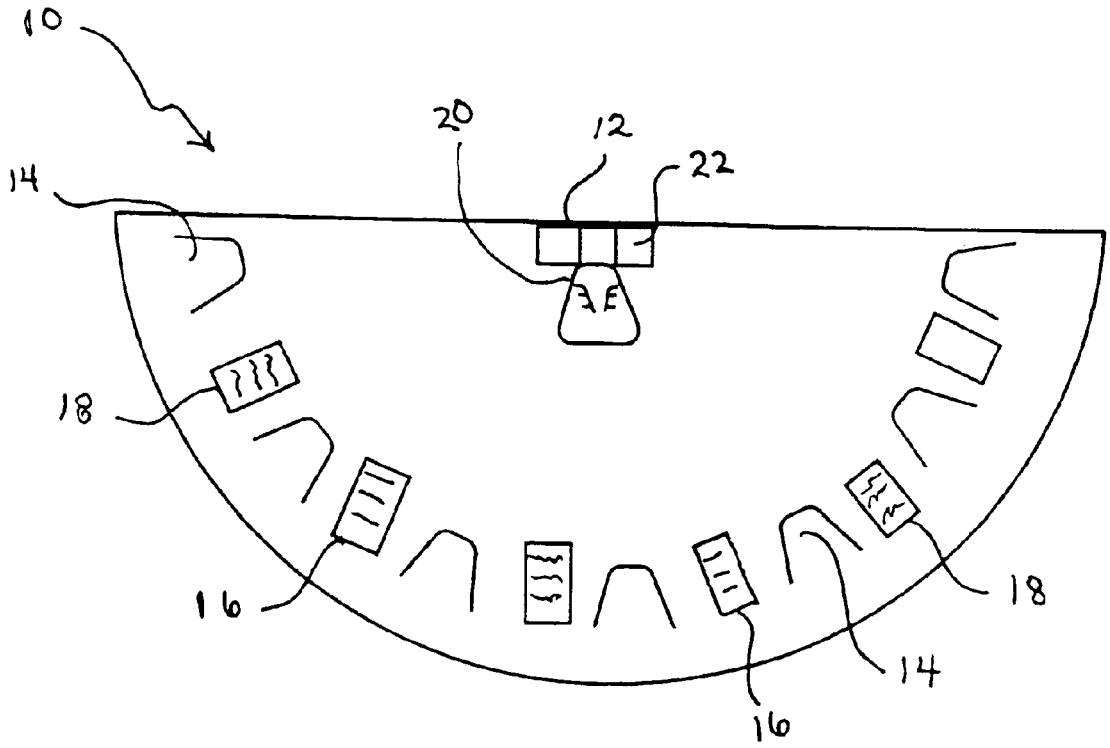
FIG. 1 is a plan view of a table for playing the casino version of the card game of the present invention.

Referring to FIG. 1, a table layout for casino play is illustrated. A table 10 is set up for seven hands as the maximum for the 52 card standard deck (seven Players plus one Dealer requires 48 cards with four left over) although the game can be played with fewer than seven players and the Dealer. No more than a single deck is required, however multiple decks may be used. Multiple deck play will require adjustment of the payout schedule to create similar house advantage percentages. Two or more decks will add more possible outcomes e.g., six of a kind. Depending on the number of players at the table 10 and consistent with the security policy of each casino, one player may play more than one hand. In the casino version, the player never touches the cards for any reason. Security measures adequate to prevent collusion and fraud in casino table games like "Caribbean Stud™" or "Let It Ride™" are sufficient to insure the integrity of one or two hands per player. As is conventional with Casino table games, the table 10 is arranged as a semi-circle with the players facing the dealer and pit area 12. Each player's position 14 is evenly distributed around the table to provide sufficient space for the comfort of the player. Indicia representing payout information 16 and playing rules 18, alternate between the positions 14. The dealer's position 20 includes an area for the dealer's bank 22. Typically, the surface of the table 10 is felt and preferably an area for holding drinks or accommodating cupholders and other personal items (not shown) is provided at each of the positions 14.

Figure 2:
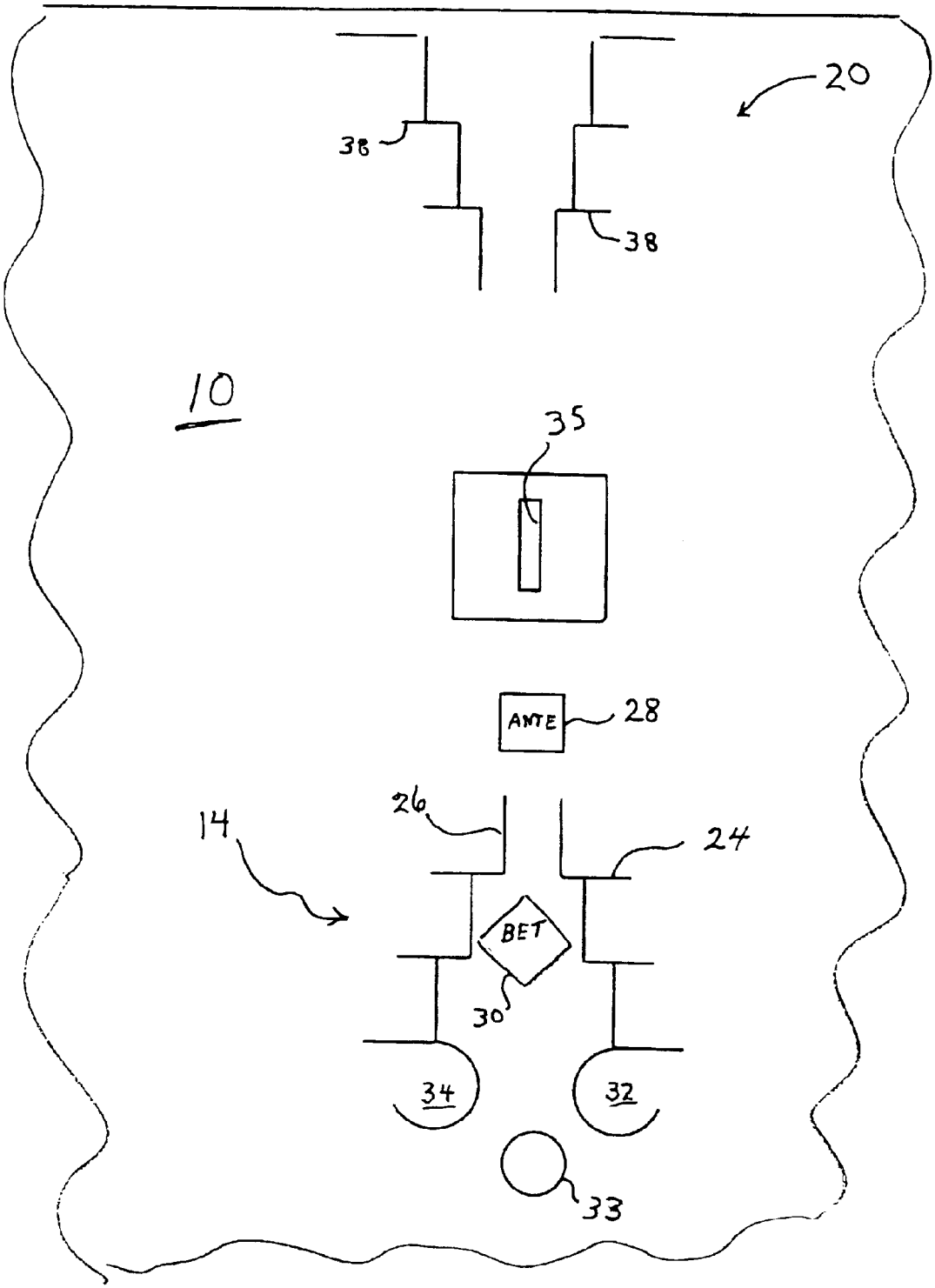
FIG. 2 is a view in enlarged scale of one player's position and the dealer's position at the table of FIG. 1.

As is more clearly shown in FIG. 2, each player's position 14 includes a first card position column, referred to as the black column 24, and a second card position column, referred to as the red column 26. It will be understood, however, that the columns may be otherwise designated by other colors or by other designations corresponding to whichever two colors representative of two suits each. Both of the columns are configured to receive three cards and in the embodiment shown, the black column 24 outlines the intersection of the left side and the bottom edge of a card while the red column 26 outlines the intersection of the right side and bottom edge of a card (as viewed from the Player's position at the table). In this manner, the dealer knows exactly where to place each card dealt and can determine at a glance if any cards have been disturbed. A square 28 is positioned between the black 24 and red 26 columns, preferably between the card position closest to the dealer for placing ante bets. Below the square 28 is a diamond shaped position 30 for additional wagering after the first round of dealing. At the lower ends of the black column 24 is a position 32 for placing a side bet that all cards dealt to the black column will be of a black suit. A similar position 34 is located at the lower end of the red column 26 for wagering that all cards dealt to the red column will be of a red suit. A parlay bet position 33 is provided for betting that all cards dealt to the black column 24 will be of a black suit and all cards dealt to the red column 26 will be of a red suit.

The dealer's position 20 is also provided with two card position columns 38 that, for casino play are preferably designated by a different color or different designation from the player's columns 24 and 26. Black/Red side games are not based upon coloration of the Dealer's hand except that a "Dead Heat" by the Dealer beats all Player Black/Red side bets in the same manner that green "0" and "00" in roulette negate all outside Black/Red wagers. Green is a good color for the Dealer's two columns 38 except when the table surface itself is green. The purpose of the Dealer's hand is to determine the numerical spread or Dead Heat.

To initiate play each player places an ante wager in the ante square 28 and makes any side bets in positions 32, 34 and 33 that may be desired. Another gaming opportunity for the Player is to wager even money that the initial card to one column will match color. Columns are bet individually, both may be played in each round. If Dealer is dealt a hand in which the difference between the Dealer's columns is zero ("Dead Heat"), the house wins all such bets. When all wagers have been placed, the dealer deals one card, face up, beginning to the left of the Dealer and continuing clockwise to the first card position in each player's black column 24 and then to the first card position in each Player's red column 26 and also in the first two card positions in the dealer's separate columns 38. The deal proceeds in a clockwise direction. At the completion of the first round of dealing, each player beginning with the player on the dealer's left, may make a wager which is double the ante amount on the betting diamond 30. If a player decides not to bet, the player not betting is considered to have folded, the ante bet is forfeited and placed in the Dealer's bank 22 and that player is out of the basic and progressive low spread portions of the game. However, if the player has placed side bets such as in positions 32, 34 and 33, the dealer will continue to deal cards in turn to that player for purposes of determining the outcome of the side bets. Upon completion of the round of betting or forfeiting, the dealer then deals cards face up in the second card position of each player's black column 24, red column 26 and the dealer's column 38 and immediately completes the deal by placing cards in the third card position of those columns.

Once the deal has been completed the dealer must determine that the difference or spread between the total value of the cards in each of the dealer's columns 38 qualifies or does not qualify announcing the hand to be dead or in play. If the dealer's spread exceeds a predetermined value set by the casino, the dealer pays each player who has not folded an amount equal to his ante bet. The player's ante bet, the Casino's match of the ante bet, and the wagers in the betting diamond 30 are returned to the players. A progressive bet 35 in all cases accrues to the progressive pool and is not returned to the Player.

If the dealer has qualified by having a spread at or below a predetermined number, the spread for each player's hand is determined by totaling the value of the cards in the black 24 and red 26 columns and taking the numerical point difference between the columns. In the basic portion of the Casino game, any player whose spread is less than the dealer's qualifying hand is a winner and is paid an amount equal to his ante 28 and winnings from the bet 30 according to the stated payout table amounts 16. Whether or not the Dealer's hand qualifies, Players who have wagered in the progressive pool by placing the required wager 35 shall be paid for hands qualifying for progressive pot payout 16. Casino rules govern in the event the dealer and player both have hands with a spread of zero. As an additional inducement to enter into progressive play, the progressive payout chart might include a set payout for such a "Double Dead Heat" between the Dealer and progressive Player.

With regard to the side bets, the pay out is determined in accordance to the odds determined by the casino and are incorporated in the pay out information 16 provided adjacent each player's position 14. For example, the house may predetermine that the set payoff for getting all three cards of a black suit in the black column 24 or of a red suit in the red column 26 to be seven to one for a wager placed at 32 or 34 respectively. This popular side bet serves the purpose of regularly paying the player's bets in the same lowest denomination chip used in progressive play.

While ante bets and other bets will be within stated "table limits", the progressive bet does not vary within a particular Progressive Pool. Certain progressive games currently in use in many U.S. casinos collect the progressive bet at $1 per hand. The Progressive bet at higher than the lowest denomination chip (but uniform within any progressive pool) allows for both rapid large top prize accumulation and exciting scheduled progressive pool payouts. Likewise, the house may, for example, determine that the set payoff of a player winning the parlay bet, that is upon completion of the deal all black suited cards in the black column 24 and all red suited cards in the red column 26 to be fifty to one. The dealer's failure to qualify does not affect the wagers in positions 32, 34 and the parlay bet 33.

As mentioned above, the feature objective of the six card spread play is to have a lower point spread between the two columns, i.e., the black column 24 and the red column 26, of three cards each dealt a player than the point spread dealer has in the dealer's two columns of three cards. A 52 card deck will typically be used with the cards having the following face values:

| Face Value | Point Value |
|---|---|
| Ace | 1 or 11 |
| Two–Ten | Face Value |
| King, Queen, Jack | 1/2 |

With adjustment, the game is adaptable to play with other card decks, such as a Spanish 48 card deck.

As mentioned above additional bets may be placed in positions 32, 34, and 33. These additional bets are placed prior to the first card being dealt. Thus, a player may wager that all the cards dealt to his black column 24 will be black suited, that is all spades and clubs, and all cards dealt to his red column will be hearts or diamonds. These wagers, referred to as black and red bets, are placed in position 32 and 34 respectively. A player may make either a black bet or a red bet or may make both a black and a red bet. There is a possibility option for slightly larger payouts for Black, Red, and Black/Red Parlay. Since the dealer's columns 38 have no color designation, in the event the dealer has a spread of zero, or a dead heat, all black and red bets are lost in the same way as the roulette ball landing in the slot for the green zero or green double zero on a roulette table takes both red and black wagers. The wager in position 33, referred to as the "parlay" bet, is a bet that the player will win if both the black column is dealt 3 black-suited cards, and the red column is dealt 3 red-suited cards within the same hand.

Payout combinations will be listed along with their odds in the indicia 16 between each two player's positions. The factors to be considered in formulating a schedule of payouts include: the numerical value of the dealer's qualifying spread, the required house advantage, and combinations included in the payout table. The following combinations may be considered as possible pay out combinations. These are not listed in any order of probability and may or may not be considered as winning hands by the casino.

General payout rule: In both the basic casino game and progressive game only the higher combination is paid when a player's cards form more than one winning combination. Any red or black bet winner is paid without respect to the results of a player's spread between the black 24 and the red 26 columns in the basic game.

Beats the spread: when dealer's spread qualifies, players difference in point value or spread between players two columns must be less than dealer's point difference between the dealer's two three card columns. The dealer wins ties.

Player "Dead Heat": This pays when the dealer's hand qualifies but does not contain a dead heat and the player's hand contains a dead heat or a zero spread.

Pairs: winning combinations exists either in the black column 24 or the red column 26; such combinations do not cross over between columns. Pairs consist of two cards of different suits with the same nomenclature. Different face cards having the same dead heat point value are not pairs. For example, the jack of diamonds and queen of clubs are each valued at ½ point but are not a pair when occurring in the same column. On the other hand, the two of hearts and the two of clubs both in either the black column 24 or the red column 26 are a pair of twos.

Four of a Kind: A Player has four cards of the six dealt which are of the same nomenclature in any position within the two columns.

Two by Two (2×2): a player has a pair in both the black column 24 and the red column 26. Two by Two in color (2×2 in color): the player has a black pair in the black column 24 and a red pair in the red column 26 with each pair of different nomenclature.

Perfect Two by Two in color (Perfect 2×2 in color) A Player has 4 cards of the same nomenclature with a pair in each column matching the column color.

Trips: same as pairs except three cards of the same nomenclature in the same column.

Three by Three (3×3): trips in each column which in a 52 card game are necessarily of different nomenclature and mixed in color.

Red or Black Bars: this combination occurs either when all three cards in either the black column 24 are spades or clubs or all three cards in the red column 26 or hearts or diamonds. The cards need not be of the same suit.

Red/Black Bar Parlay: this combination occurs when there is both a red color bar and a black color bar dealt to a player in the same hand. The cards do not have to be of the same suit.

Off-sides Flush: occurs when three cards in the same column are of the same suit but are of opposite color to the column. For example the 3, 4 and King of diamonds in the black column 24.

On-sides Flush: occurs when the flush occurs in the column of its own color. For example, the ace of spades, jack of spades, and seven of spades in the black column 24.

Straight: occurs when three cards in any column dealt in any order are sequential. For example, the ten of diamonds, queen of hearts, jack of clubs in the red column 26.

Superb Straight: this combination occurs when the straight occurs in the column of its own color. For example the eight of diamonds, ten of hearts, nine of diamonds occur in the red column 26.

Straight Ordered Sequence (SOS): this combination occurs when a straight contains three sequential cards dealt in ascending order in either the black column 24 or the red column 26. For example, the first card dealt in the black column 24 is the six of diamonds. The second card is the seven of clubs and the third card is the eight of spades.

Red or Black Straight Ordered Sequence: this combination occurs when a straight of ascending sequence is dealt in order in the color of its card suits. For example, in the black column 24, the first card is the two of clubs, the second card dealt is the three of spades and the third card dealt in the four of clubs.

Ace High Straight Ordered Sequence: occurs when any three card sequence is dealt on either the black column 24 or the red column 26 in the following order; the first card is the queen of any suit, the second card is the king of any suit and the third card is the ace of any suit. For example the queen of diamonds, the king of spades and the ace of clubs dealt in that order in the black column 24.

Red or Black Ace High Straight Ordered Sequence: this combination occurs when any three card sequence of a color is dealt on the column of the same color in the following order; queen, king, ace. For example in the black column 24 the first card dealt in the queen of clubs, the second card is the king of spades and the third card dealt is the ace of clubs.

The "Too Bad" Straight Flush: this combination occurs when three sequential cards are dealt in the order are suited but on the opposite colored column. For example, the eight of hearts, the seven of hearts, and six of hearts are dealt on the black column 24.

Red or Black Flush: this combination occurs when the straight flush is dealt on the column matching the suit color. For example the three of spades, the two of spades and the four of spades all dealt on the black column 24.

Red or Black Ace High Straight Ordered Sequence: a three-card sequence of a color is dealt on the column of the same color in the following order, queen, king, and then the ace. For example, the black column 24 the first card dealt in the queen of clubs, the second card the king of spades and the third card the ace of clubs.

The "Too Bad" Straight Order Flush: Occurs when three sequential cards of the same suit are dealt in ascending order, but on the opposite color. For example, the 10 of clubs, the jack of clubs, and the queen of clubs are dealt in that order on the red column 26.

The Red or Black Straight Flush: Occurs when the three cards of the same suit are dealt into the column of the same color in ascending order. For example, the 10 of clubs, the jack of clubs and the queen of clubs are dealt in that order into the black column 24.

The "Too Bad" Royal Three Card Flush: This combination occurs when the royal flush is dealt in any order into the column of opposite color. For example, into the black column 24 is dealt the ace of hearts, the queen of hearts and the king of hearts.

Red or Black Royal Three Card Flush: This occurs when the royal flush is dealt in any order into the column of the same color. For example, into the red column 26 is dealt the ace of hearts, the queen of hearts, and the king of hearts.

The Sequential Red or Black Three Card Royal Flush: This combination occurs when three cards of the same suit are dealt into the column of the same color in this order: queen, king, ace. For example, the first card dealt to the black column 24 is the queen of spades, the second card is the king of spades and the third card is the ace of spades.

The "Too Bad" Sequential Three Card Royal Flush: This combination occurs when three cards of the same suit are dealt into the column of the opposite color in this order: queen, king, ace. For example, the queen of spades, the king of spades and the ace of spades are dealt in that order into the red column 26.

The Ultimate Red and Black Sequential Three Card Royal Flush: This combination occurs when a sequential red and a sequential black three card royal flush are dealt in a single hand. For example, into the red column 26 was dealt in this order: the queen of hearts, the king of hearts and the ace of hearts or a similar deal with diamonds and into the black column 24 was dealt the queen of spades, the king of spades and ace of spades or alternatively the queen of clubs, the king of clubs and ace of clubs.

The Superlative Ultimate: This combination occurs only when the player's hand contains an Ultimate Red and Black Sequential Three Card Royal Flush and in the same deal the dealer has a "Dead Heat" hand.

It will be understood that the invention can be embodied in a wide variety of forms and media. For example, single and multiple coin slot machines, video slot machines, scratch card formats, and pull-tab formats can be utilized for play of the game.

Figure 3:
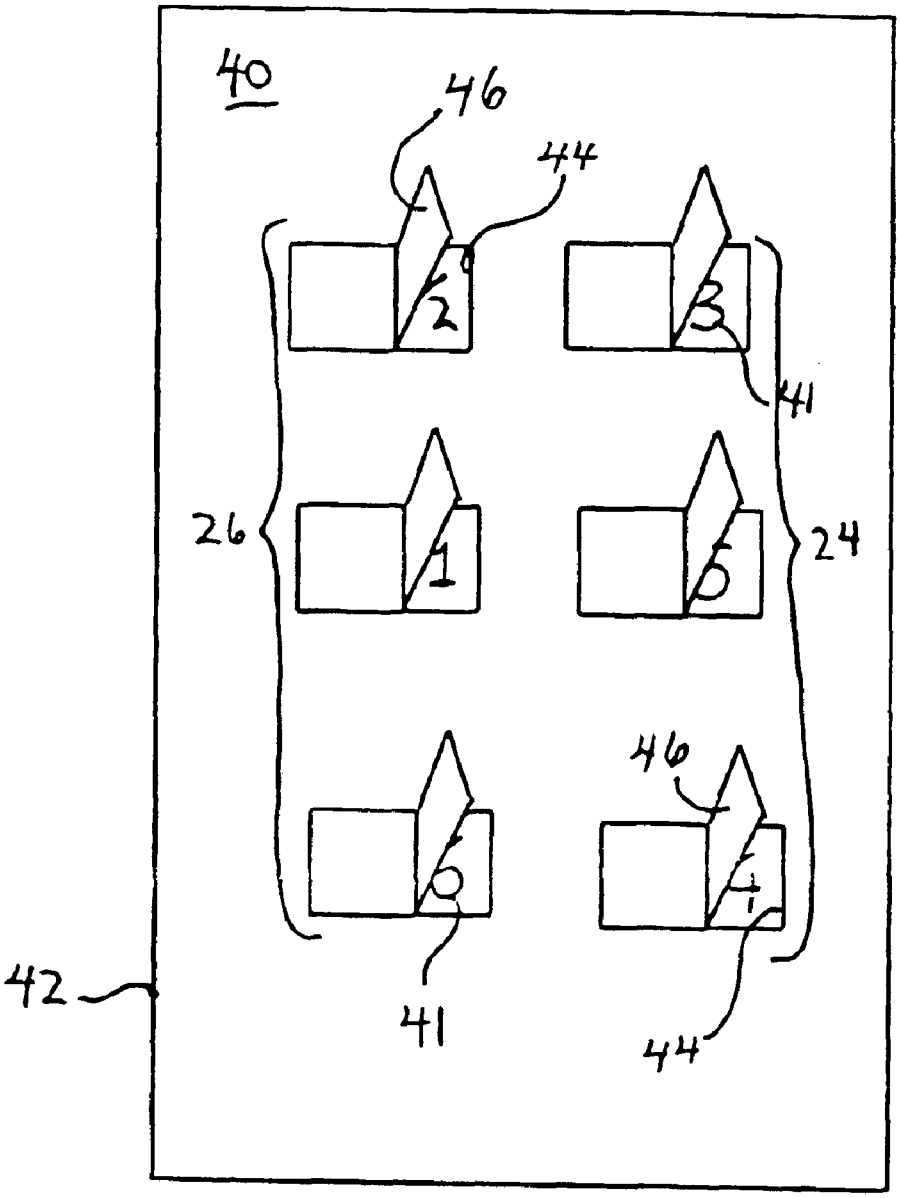
FIG. 3 illustrates a pull-tab card used for playing the pull-tab version of the game.

In this context referring to FIG. 3, a basic pull tab card 40 is provided with six numbers in two columns of three numbers each. Each column represents the black 24 and red 26 columns and preferably the numbers are printed in the color of their respective columns. Overlying the number columns is a sheet 42 which is provided with six windows 44 normally sealed by a pull tab 46. The windows 44 are arranged in two columns of three windows each. Each window tab 46 overlies a printed number or icon with a numerical value. When the pull tabs 46 are removed the numbers are exposed in the windows 44. In this version there is no dealer qualification and payout is based on predetermined spread payouts set by the rules of the game. The amount of payout is shown on a payout table printed on the device and is dependent on the difference between the player's spread and the pre-determined spread or stated winning combination. Thus, assuming the player's spread is less than the predetermined spread, the greater the difference the higher the pay out or the scheduled payout may only be awarded for an actual "DeadHeat".

"Dead Heat—Beat The Spread" games may be played in the Scratch-off card format used as additional games by many lottery companies. Such games are simple game themes like "Beat the Dealer's Card", "Tic-tac-toe", uncovering a certain number of hidden number of symbols or numbers. Payouts for winning combinations are preprinted on the card face. Once the card is purchased, the player scratches off the opaque material revealing the numbers or symbols which may or may not be in a winning configuration(s). The "Dead Heat—Beat the Spread" theme and format may be incorporated in the game as an embodiment of the casino card game, or as races between icons of e.g. horses, greyhounds, stock cars, turtles and rabbits, power boats, yachts, or track and field events.

As will be understood by those skilled in the art, various arrangements which lie within the spirit and scope of the invention other than those described in detail in the specification will occur to those persons skilled in the art. It is therefor to be understood that the invention is to be limited only by the claims appended hereto.

Having defined the invention, I claim:

1. A method of playing a card game among a number of players, one of said players being a dealer, said method including the steps of:

a. determining the point values of playing cards with the values being, Ace=1 or 11, King=½, Queen=½, Jack=½, and the point value of all other cards being equal to their rank;

b. designating a first column and a second column for each player;

c. said dealer dealing a card to said first column and to said second column of each of said players including said dealer, d. repeating step c. until there are three cards in each of said player's first and second columns;

e. calculating a spread between each player's first column and second column by totaling said point value of the cards in each column and subtracting the lowest total from the highest total to arrive at a difference that is the spread between a player's columns;

f. determining the winning hand by comparing each player's spread with the player with the lowest spread having the winning hand, provided that players with equal spreads are tied.

2. The method of claim 1 wherein prior to dealing cards each player places an ante bet to form a pot and the player with the lowest spread wins the pot, provided that players with equal low spreads are tied and the pot is equally distributed between said players with equal low spreads.

3. The method of claim 2 wherein after a first card has been dealt to each player's first column and second column, a player may place an additional bet and each player desiring to continue on in the game must match or raise the player's bet.

4. The method of claim 2 wherein prior to the cards being dealt a player may make additional bets relating to the suit and rank of cards in each said player's first and second columns.

5. The method of claim 2 wherein prior to the cards being dealt a player may make a progressive bet into a progressive betting pool that is paid out in the event of a predetermined arrangement of cards being dealt into either said first and second card position column.

6. The method of claim 2 wherein prior to the cards being dealt a player may make a progressive bet into a progressive betting pool that is paid out in the event of a predetermined arrangement of cards being dealt into both said first and second card position column.

7. The method of claim 1 wherein an optional poker game is also played utilizing the cards of a players first column and second column to make a poker hand and the winning hand being determined in accordance with conventional poker hand rank.

8. The method of claim 7 wherein said player with the winning poker hand shares the pot in pre-determined shares with said player with said low spread hand.

9. The method of claim 1 wherein an optional double three card poker game is also played utilizing the three cards of said players first column and the three cards of said players second column, the cards in each column comprising a poker hand, winning hands being determined in accordance with conventional three card poker rank.

10. The method of claim 9 wherein the designation of dealer passes at the conclusion of each round of said game to the player on said dealer's left, provided, however, the player on the dealer's left may pass to the player on that player's left, passing of the deal may continue until a player accepts the designation of dealer.

11. The method of claim 1 wherein all players play against said dealer.

12. The method of claim 11 wherein said dealer's spread must be at or below a predetermined value and when said dealer's spread exceeds the predetermined number each of said players remaining in the game are paid an amount equal to their ante bet and all bets made on the outcome of the comparison of said players' spread to said dealer's spread are returned.

13. The method of claim 11 wherein only one player is designated as the dealer for all rounds of said game.

14. The method of claim 11 wherein said dealer wins all ties of the spread.

15. A method for playing a wagering casino type card game involving a casino dealer and a number of players, said game based on a point value spread between two columns of cards, each of said cards having an assigned point value based on the rank of said cards, said game comprising the steps of:

a. providing a first and a second column for each player and said casino dealer;

b. each player placing an ante bet prior to beginning a deal;

c. dealing a card face-up to said first column and to said second column of each of said players and to said casino dealer's two columns;

e. providing each player an opportunity to place an additional wager, any player failing to place said additional wager forfeits that player's ante bet;

f. repeating step c. until there are three cards each of said player's first column and second column and in said casino dealer's first and second columns;

g. qualifying said casino dealer by totaling the point value of the cards in each of said casino dealer's columns and subtracting the lowest total from the highest total to arrive at a difference that is the spread between said dealer's columns, said spread being equal to or below a predetermined number for said dealer to qualify, h. paying each of said players remaining in the game an amount equal to the ante bet and returning all other bets of said players remaining in the game in the event said dealer fails to qualify;

i. evaluating the hand of each player remaining in the game by determining the total point value of the cards in each said first and second column and subtracting the lowest total from the highest total to arrive at a difference that is the spread between a player's columns in the event said dealer qualifies;

j. determining a winning hand by comparing the player's spread against the dealer's spread, the lowest spread wins; and k. paying and collecting bets depending on whether said dealer qualifies and said player's spread is higher or lower than said dealer's spread.

16. The method of claim 15 wherein a player remaining in the game with a spread of zero is an automatic winner except where said dealer also has a spread of zero whereupon the game is a push and said player's bets relating to said spread are returned.

17. The method of claim 15 wherein said first and said second columns of said players are given a color designation.

18. The method of claim 15 wherein said player's first column is designated black and said second column is designated red.

19. The method of claim 18 wherein said player may make an parlay wager that all cards dealt to said first and said second columns will be of a suit that matches the color designation of one of said first and second columns.

20. The method of claim 18 wherein said player may make a wager that all cards dealt to one of said black column and red column will be of a suit that matches the color designation of the column to which said cards have been dealt.

21. The method of claim 18 wherein said player may make a wager that the cards dealt to said columns will be of a defined face value.

22. The method of claim 18 wherein said player may make a wager that the cards dealt to one of said columns will be of a defined face value and color that matches the color designation of the column to which said cards have been dealt.

23. The method of claim 18 wherein said player may make a wager that the cards dealt to one of said columns will be dealt in a particular sequence of rank.

24. The method of claim 18 wherein said player may make a wager that the cards dealt to one of said columns will be dealt in a particular sequence of rank and color that matches the color designation of the column to which said cards have been dealt.

25. The method of claim 18 wherein said player may make an progressive wager that all cards dealt to said first and said second columns will be of a suit that matches the color designation of one of said first and second columns.

26. The method of claim 18 wherein said player may make a progressive wager that all cards dealt to one of said black column and red column will be of a suit that matches the color designation of the column to which said cards have been dealt.

27. The method of claim 18 wherein said player may make a progressive wager that the cards dealt to said columns will be of a defined face value.

28. The method of claim 18 wherein said player may make a progressive wager that the cards dealt to one of said columns will be of a defined face value and color that matches the color designation of the column to which said cards have been dealt.

29. The method of claim 18 wherein said player may make a progressive wager that the cards dealt to one of said columns will be dealt in a particular sequence of rank.

30. The method of claim 18 wherein said player may make a progressive wager that the cards dealt to one of said columns will be dealt in a particular sequence of rank and color that matches the color designation of the column to which said cards have been dealt.

31. The method of claim 15 wherein after a first card has been dealt to each player's first column and second column, each player must place an additional wager in order to remain in the game.

* * * * *